US008234840B2

(12) United States Patent
Griffin et al.

(10) Patent No.: US 8,234,840 B2
(45) Date of Patent: Aug. 7, 2012

(54) FORM, FILL, AND SEAL SYSTEM

(75) Inventors: Mark Griffin, San Bernardino, CA (US); Steven Davis, San Bernardino, CA (US); John Hildebrand, San Bernardino, CA (US); Todd Jahnke, San Bernardino, CA (US)

(73) Assignee: Winpak Lane, Inc., San Bernardino, CA (US)

( * ) Notice: Subject to any disclaimer, the term of this patent is extended or adjusted under 35 U.S.C. 154(b) by 199 days.

(21) Appl. No.: 12/781,794

(22) Filed: May 17, 2010

(65) Prior Publication Data

US 2011/0047939 A1 Mar. 3, 2011

(51) Int. Cl.

| | |
|---|---|
| ***B65B 61/20*** | (2006.01) |
| ***B65B 61/18*** | (2006.01) |
| ***B65B 9/20*** | (2006.01) |
| ***B31B 1/84*** | (2006.01) |

(52) U.S. Cl. ..... 53/410; 53/412; 53/451; 53/133.2; 493/213

(58) Field of Classification Search ..... 53/410, 53/412, 451, 133.2, 551; 493/87, 213; *B65B 61/18, B65B 6/20; B31B 1/84*

See application file for complete search history.

(56) References Cited

U.S. PATENT DOCUMENTS

| | | | | |
|---|---|---|---|---|
| 3,894,381 | A * | 7/1975 | Christine et al. | 53/133.2 |
| 4,055,032 | A * | 10/1977 | Hammond | 53/410 |
| 4,246,062 | A * | 1/1981 | Christine | 53/410 |
| 4,695,337 | A * | 9/1987 | Christine | 53/410 |
| 4,709,528 | A * | 12/1987 | Merkus | 53/133.2 |
| 4,779,397 | A * | 10/1988 | Christine et al. | 53/410 |
| 4,924,655 | A * | 5/1990 | Posey | 53/133.2 |

* cited by examiner

*Primary Examiner* — Stephen F Gerrity

(57) ABSTRACT

A form, fill and seal system having a product fill assembly, a tube forming assembly and a fitment securing assembly. The system allows for the relative positioning of the fitment that is to be applied to the film that forms the bags, at various points along the film by having the fitment securing assembly relatively positionable with respect to the tube forming assembly. In turn, with adjustments, a fitment can be located at a number of locations on a finished bag.

14 Claims, 6 Drawing Sheets

FORM, FILL, AND SEAL SYSTEM

CROSS-REFERENCE TO RELATED APPLICATION

This application claims priority from U.S. Provisional Pat. App. Ser. No. 61/216,361, filed May 15, 2009, entitled "Fitment To Film Applicator Apparatus For An FFS Machine," the entire disclosure of which is hereby incorporated by reference in its entirety.

BACKGROUND OF THE DISCLOSURE

1. Field of the Disclosure

The disclosure relates in general to Form, Fill and Seal equipment (commonly referred to as FFS equipment), and more particularly, to a system and method for applying a fitment in various locations on a bag that is formed and filled in such equipment.

2. Background Art

The use of FFS equipment in packaging is well known. A film is provided to an FFS system. The system makes a tubular structure from the film, then applies a transverse seal, fills above the transverse seal, then forms a second transverse seal to complete a bag that is filled. Certain of these bags formed by FFS equipment further include a fitment that is secured to a portion of the bag. Typically, FFS equipment that creates and fills bags that include a fitment typically allow for the placement of the fitment at a predetermined location or within a narrow range of locations. It is difficult for a single piece of equipment to be modified to support placement of a fitment at a plurality of different locations.

Thus, it is an object of the present invention to provide a fitment to film applicator which allows for the positioning of the fitment either externally or internally.

It is another object of the present invention to provide a fitment to film applicator which allows for placement of the fitment at any radial orientation around the packaging.

It is another object of the present invention to provide a fitment to film applicator which allows for the placement of the fitment at any vertical location along the package.

These objects as well as other objects of the present invention will become apparent in light of the present specification, claims, and drawings.

SUMMARY OF THE DISCLOSURE

The disclosure is directed to a form fill seal system comprising a product fill assembly, a tube forming assembly and a fitment securing assembly. The product fill assembly has an inner product supply tube with a proximal end and a distal end. The proximal end is attachable to a product supply source. The tube forming assembly has a vertical seal anvil having a first end and a second end. The vertical seal anvil extends about the product fill assembly. A vertical seam sealer is positioned along the vertical seam sealer between the first and second ends thereof. A fitment securing assembly comprising a fitment housing tube is positioned about the inner product supply. The fitment housing tube has a fitment channel extending therealong and has a fitment insertion end and a fitment coupling end. A fitment sealing member corresponds to the fitment coupling end of the fitment channel. The fitment housing tube and the fitment sealing member, on the one hand, and the vertical seal anvil, on the other hand are rotatably positionable relative to each other, to, in turn, allow for the varying of the position of a fitment relative to the vertical seal anvil.

In some embodiments, the forming assembly further includes a forming station positioned proximate the first end of the vertical seal anvil.

In other embodiments, the inner product supply tube and the vertical seal anvil are substantially fixed in orientation relative to each other.

In still other embodiments, the fitment channel can be rotated an arcuate width of at least 90°.

In another embodiment, the fitment sealing member is vertically adjustable relative to the vertical seal anvil, to in turn, allow for the placement of the fitment at various locations along a film placed within the system.

In another preferred embodiment, the system further includes a drive system configured to pull film through the system. The drive system has a plurality of drive wheels rotatably positionable about a film positioned on the vertical seal anvil, and, a plurality of idler wheels positioned proximate a second end of the fitment housing tube. The plurality of drive wheels correspond to the idler wheels, to, in turn, cooperate with each other to pinch and, in turn, linearly pull a film therebetween, upon rotation of the drive wheels.

In yet another aspect of the invention, the invention comprises a method of applying a fitment to a film in a form fill seal system comprising the steps of: providing an vertical seal anvil; providing an inner supply tube inboard of the vertical seal anvil; providing a fitment housing tube about the inner supply tube, the fitment housing tube having a fitment channel which is rotatably positionable; providing a fitment sealing member positionable to be substantially correspondable with the fitment channel; at least one of rotatably adjusting the position of the fitment channel, and rotatably adjusting the fitment sealing member to correspond to the fitment channel; providing at least one fitment into the fitment channel; placing the fitment into substantial abutment with a film placed about the vertical seal anvil; and sealing the fitment to the film with the fitment sealing member.

In a preferred embodiment, the invention further comprises the step of vertically adjusting the position of the fitment sealing member.

BRIEF DESCRIPTION OF THE DRAWINGS

The disclosure will now be described with reference to the drawings wherein.

DETAILED DESCRIPTION OF THE DISCLOSURE

Figure 1:
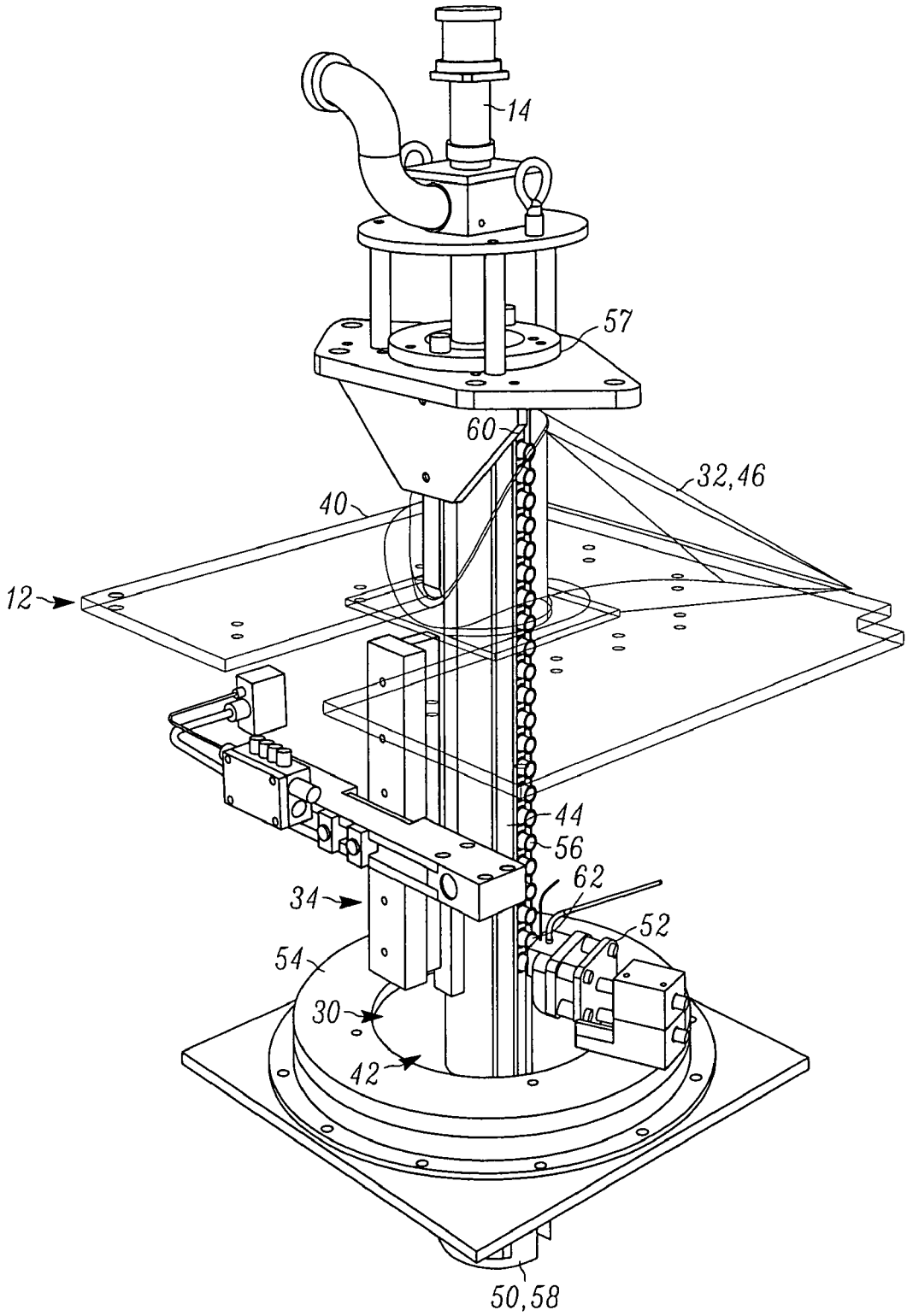
FIG. 1 of the drawings is a perspective view of an embodiment of the present system.

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, form fill seal system is shown generally at 10. With reference to FIGS. 6*a* through 6*g*, the system of the present invention is well suited for applying a fitment 101 to a number of different locations on a resulting filled bag, such as filled bag 100, having vertical seam 102, transverse seam 103 and transverse seam 104. The fitment can be positioned on the inside or the outside of the bag and at various locations. Additionally, an opening can optionally be provided proximate the fitment. It will be understood that the present invention allows for the placement of the fitment in a number of different locations.

Figure 2:
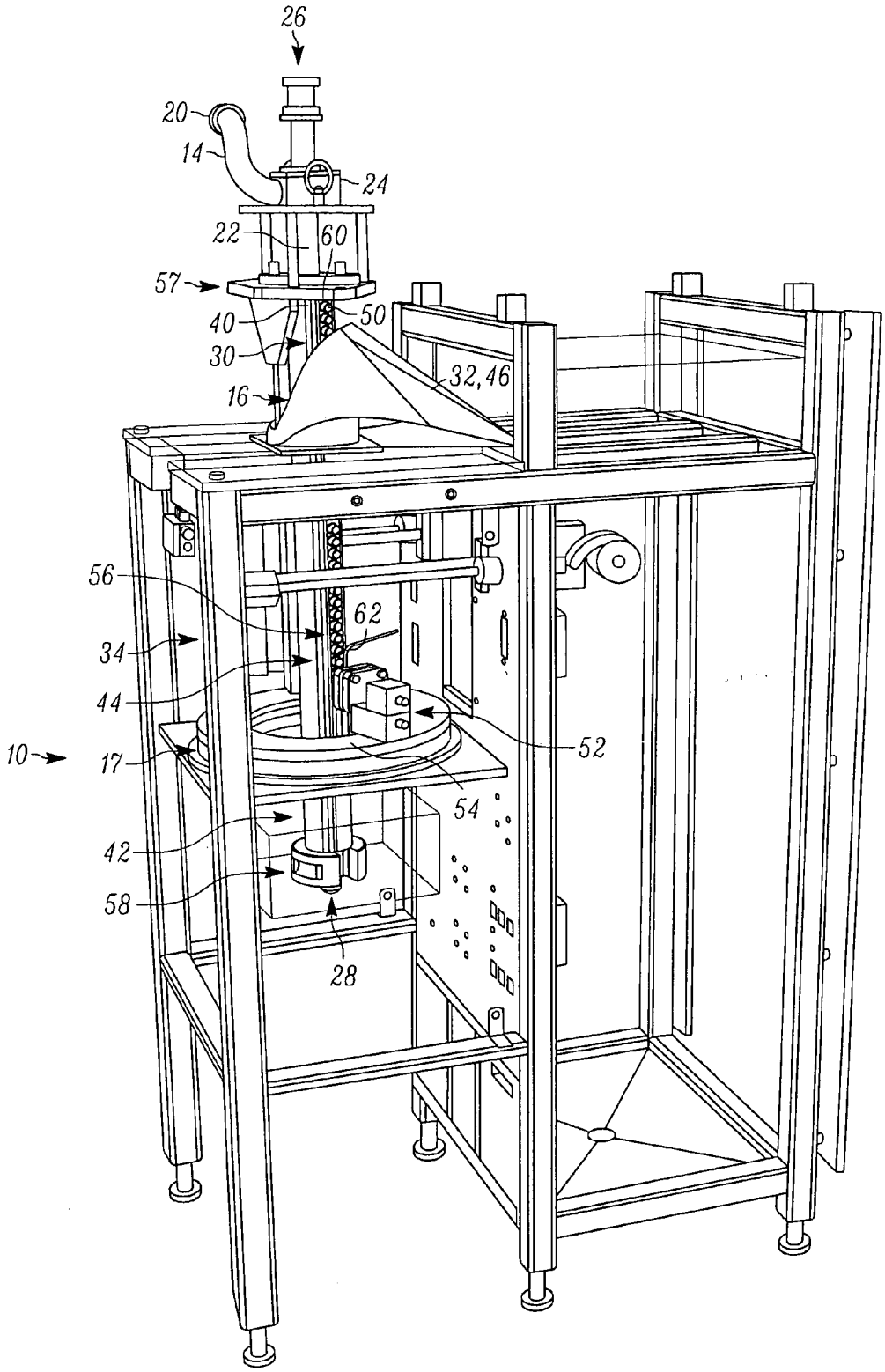
FIG. 2 of the drawings is a partial perspective view of an embodiment of the present system.
Figure 3:
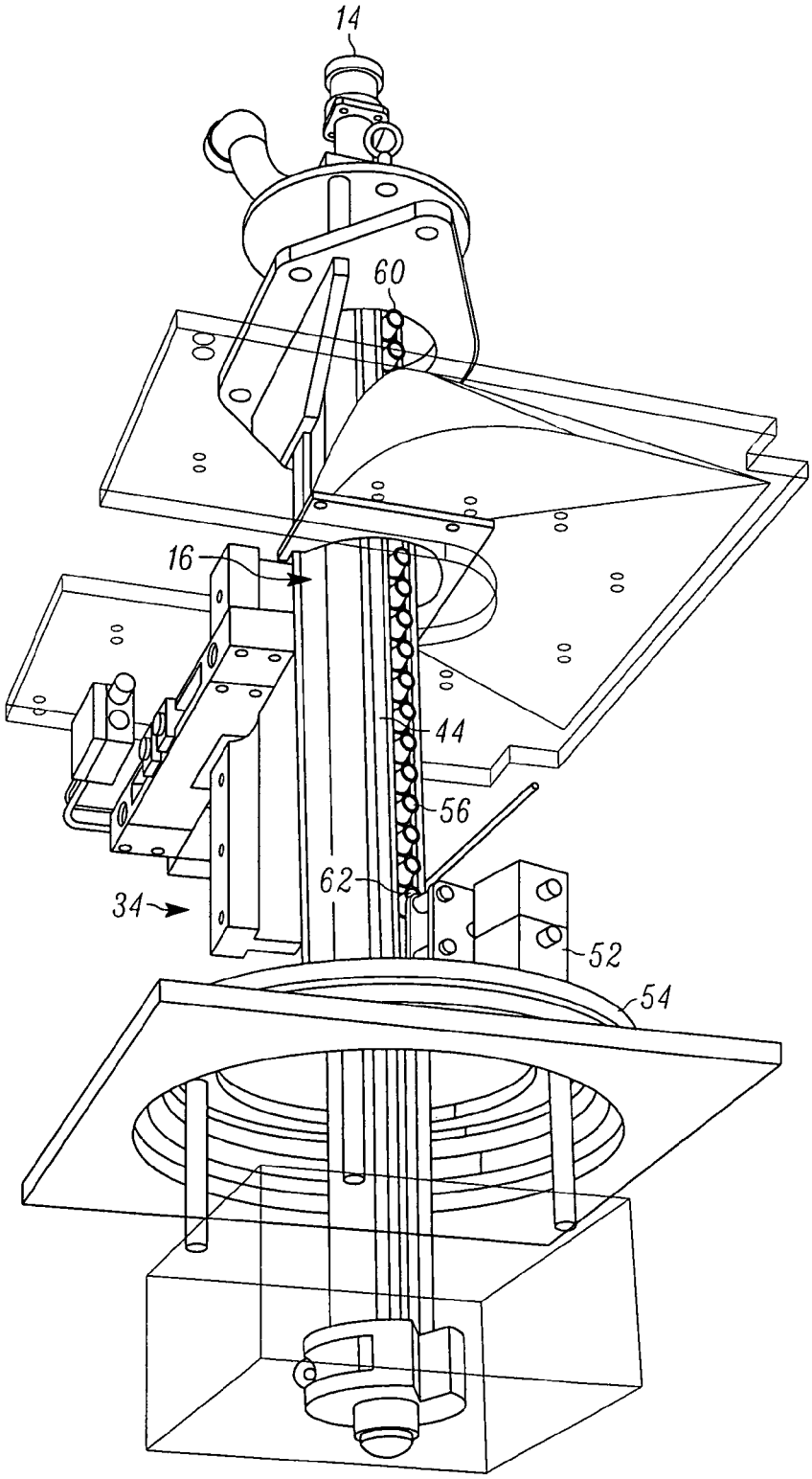
FIG. 3 of the drawings is a partial perspective view of an embodiment of the present system.

With reference to FIGS. 1 through 3, the system comprises a frame 12, product fill assembly 14, tube forming assembly 16, fitment securing assembly 17 and bag forming assembly (not shown) which applies the transverse seals. The frame 12 provides a base for the various components. Typically the frame comprises a plurality of cross members to which the various components are directly or indirectly coupled. The frame is configured for vertical form fill and seal configurations, however, it is contemplated that the frame can be configured in a direction other than vertical. The present invention describes an embodiment oriented in a vertical top down orientation. It will be understood that the use of terms such as above, below, upstream and downstream and the like is meant to describe relative positioning and not necessarily absolute positioning. As such, the invention is intended to cover form fill and seal equipment that is oriented in an orientation other than vertical.

The product fill assembly 14 comprises a product supply source 20, an inner product supply tube 22 and a valve 24. The product supply source 20 may comprise piping that ultimately connects to a tank or other larger vessel configured to retain and dispense flowable material such as liquids, syrups, powders and the like. The product supply tube 22 is coupled to the frame 12 and includes a proximal end 26 and a distal end 28. While it is contemplated that the product supply tube can be rotatably or pivotably mounted to the frame, in the embodiment shown, the product supply tube is fixed to the frame and substantially precluded from rotation, pivoting and/or translation. The proximal end is coupled to the product supply source and the distal end is configured to dispense product into the formed bags. The valve 24 may be positioned between the inner product supply tube and the product supply source, or at either one thereof. The valve is configured to selectively allow product to be dispensed from the product supply source to the inner product supply tube.

Figure 4:
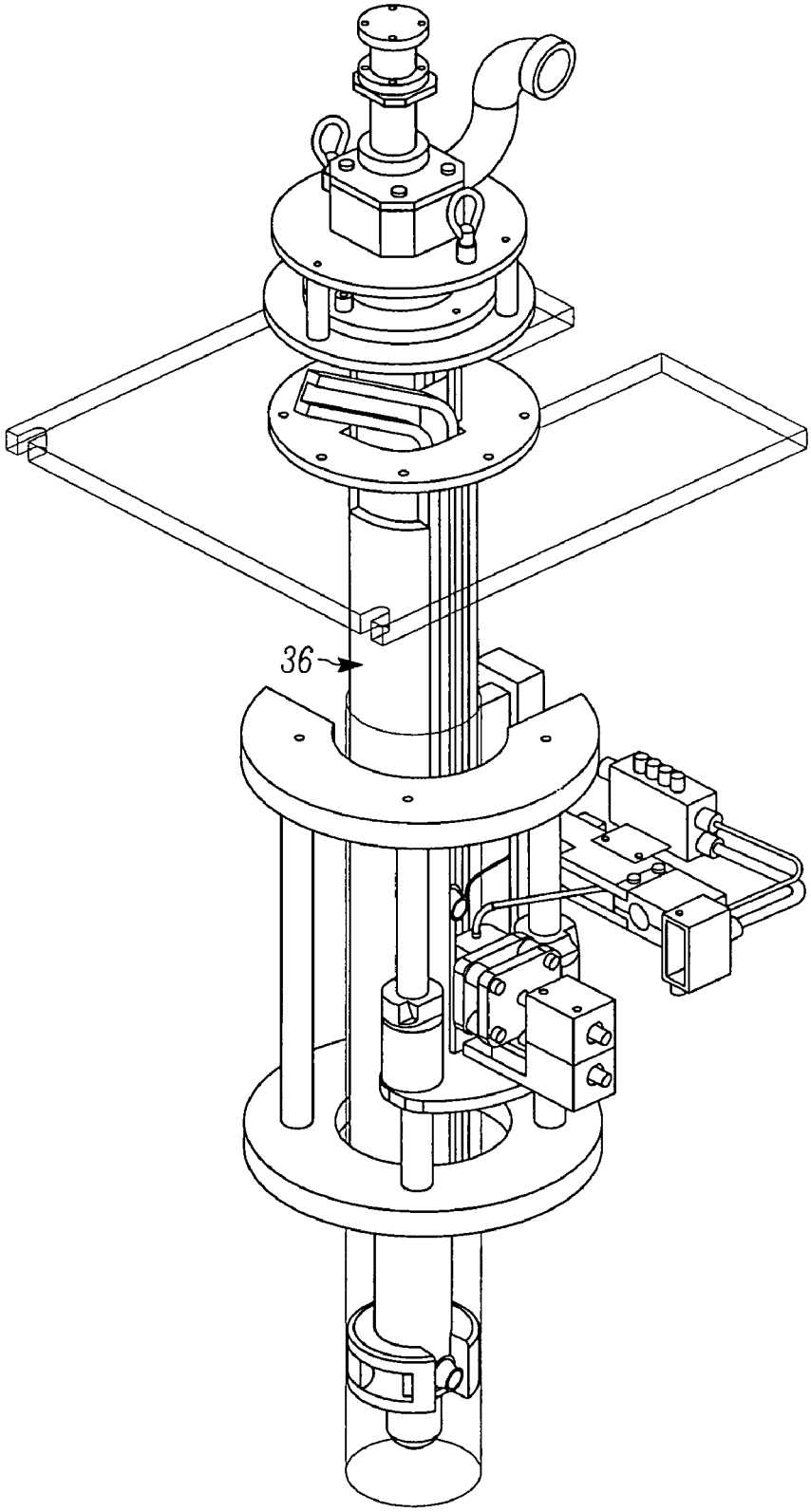
FIG. 4 of the drawings is a partial perspective view of an embodiment of the present system.

The tube forming assembly 16 is shown in FIGS. 1 through 3 as comprising an vertical seal anvil 30, forming station 32, vertical seam sealer 34 and slot cover 36 (FIG. 4). The tube forming assembly is configured to transform a substantially planar film (from for example a roll of film, which is not shown) into a tubular configuration, for eventual filling, transverse sealing and separating of tubular configuration into separate filled bags.

The vertical seal anvil 30 includes first end 40 and second end 42. The vertical seal anvil 30 is coupled to the frame. In the embodiment shown, the vertical seal anvil 30 is fixed to the frame and substantially precluded from rotation, pivoting and/or translation relative thereto. The vertical seal anvil 30 is positioned so as to provide a surface upon which the vertical seam sealer can act. In certain embodiments, the vertical seal anvil may comprise an elongated tubular member or outer vertical seal tube. In such an embodiment, a slot 44 (FIG. 4) extends at least partially along the length of the outer vertical seal tube. The slot has a width which is preferably equal to at least a quarter of the outer circumference thereof. In the embodiment shown, the slot is larger than 90° or a quarter of the circumference of the overall tube forming assembly. As will be explained, the slot is configured to receive the fitment channel 56 of the fitment housing tube 50. A spacer member can be inserted to cover a portion of the slot if needed.

The forming station 32 surrounds the first end 40 of the vertical seal anvil and includes an outer surface configuration 46. The forming station assists the transformation of a substantially planar film into the desired tubular configuration at relatively high speed without damaging the underlying film. The invention is not limited to any particular formation or configuration of the forming station, and it will be understood that a number of different configurations of the same are well known in the art.

Vertical seam sealer 34 is positioned to overlie the vertical seal anvil 30 between the first and second end thereof. It will be understood that as the film is transformed into a tubular configuration, the sides of the film meet and overlap. The vertical seam sealer 34 is positioned at the overlap to seal the ends of the film to, in turn, form the tubular configuration. The vertical seam sealer can utilize heat sealing techniques, RF sealing techniques, ultrasonic sealing techniques, among others to form the substantially continuous seam joining the two side edges of the film to form the tubular configuration.

The fitment securing assembly 17 is shown in FIGS. 1 through 3 as comprising fitment housing tube 50, fitment sealing member 52 and rotating turret 54. Fitment housing tube 50 is placed outside of the inner product supply tube 22 and in proximity of the vertical seal anvil 30. The fitment housing tube 50, in the embodiment shown is rotatably positionable relative to each of the inner product supply tube and the vertical seal anvil. The fitment housing tube includes a first end 57 and a second end 58. The first end extends beyond the vertical seal anvil 30 in either direction. Further the fitment housing includes fitment channel 56 which has an insertion end 60 and a coupling end 62. The insertion end is positioned proximate the first end of the fitment housing tube. The coupling end is positioned between the first and second ends of the fitment housing tube. The fitment channel 56 is configured to slidably retain a plurality of fitment in substantially sequential orientation. The fitment channel 56 is configured so that when the fitment is inserted into the channel, the surface of the fitment which is to be coupled to the film corresponds spatially with the vertical seal anvil so that the fitment is placed in substantial abutment with the film.

The fitment sealing member 52 is positioned on the rotating turret 54 and can rotate along the outside of the movement of the film therealong. The travel of the rotating turret is such that the fitment sealing member is positioned near the coupling end 62 of the fitment channel 56 to correspond to the orientation of the fitment when the fitment is positioned in the desired position for attachment thereof to the film. The fitment sealing member 52 is configured to seal the fitment to the film in any number of different attachment means, such as RF sealing, ultrasound, heat sealing, and the like. In certain embodiments, the fitment sealing member 52 can translate up and down, as desired.

The bag forming assembly which is not shown comprises at least one transverse sealer positioned beyond the distal end 28 of the inner product supply tube 22. As is well known in the art, after formation of the tubular film, the transverse sealer seals a lower seam (which is the upper seam of the immediately preceding formed bag), then allows for the inner product supply tube 22 to fill the bag. Once filled, the bag is advanced, and the horizontal sealer seals a substantially transverse seal to complete the formation of the filled bag (and to simultaneously form the bottom of the subsequent bag). Of course, other transverse sealers or structures which form the bottoms and tops of the containers are contemplated for use. The foregoing is only exemplary and the invention is not limited to such a sealer, or such sealing mechanisms in general.

In operation, a roll of film is provided. The film typically is provided in rolls of varying width and size. The film can be pulled directly from the roll into the system, or, alternatively, may need to be trimmed or otherwise resized prior to insertion into the system. A number of different films are contemplated for use. Such films typically comprise a monolayer film, or various laminates or coextruded film structures. In certain embodiments, such films may be metallized or otherwise surface treated. Graphics or other indicia may be applied to the films either prior to, or after formation.

Additionally, the product is placed into the product supply source. The invention is not limited to any particular product that can be placed in the resulting bags. It is contemplated that the products comprise flowable material, such as liquids of varying viscosities (puree's, syrups, oils, water based products, gels), as well as suspensions, granular solids, powders, combinations of the foregoing, and the like.

Next, it is determined where the fitment is intended for positioning. Once it is determined, the fitment housing tube 50 is rotated relative to the vertical seal anvil into the desired configuration. In the embodiment shown, the vertical seam sealer is substantially stationary, thus movement of the fitment housing tube repositions the desired orientation of the fitment relative to the vertical seam (and also the transverse seam). Once positioned as desired, the fitment housing tube is secured. It is contemplated that approximately 90° of rotational movement of the fitment housing tube allows for placement of the resulting fitment anywhere from the center of the bag to the edges of the bag. Of course, for particular applications, it may be desirable to allow a greater or lesser relative rotative movement of the fitment housing tube and the vertical seal anvil.

Next, the fitment sealing member is adjusted and positioned in the desired orientation. In particular, the fitment sealing member is rotated on the rotating turret until it is positioned so as to substantially overlie a portion of the fitment channel, to be in a position to seal a fitment from the fitment channel to the underlying film. The fitment sealing member can likewise be adjusted in a vertical orientation, to, in turn, adjust the vertical position of the fitment on the resulting bag. The travel of the fitment sealing member, it is contemplated will substantially correspond to the length of a resulting bag, to, in turn, allow the fitment to be located anywhere between the upper and the lower seams (typically horizontal) of the resulting bag. In other embodiments, slack take up rollers can be employed to change the effective length of a bag, to, in turn, adjust the position of the fitment relative to the upper and lower transverse seals.

The fitment sealing member can be coupled to a source of fitments. The fitments are sequentially introduced into the fitment channel at the insertion end. The invention is not limited to any particular type of fitment, or a fitment made from any particular material. A number of different fitment structures and configurations are contemplated for use. In most such fitments, the fitment includes a surface which is configured for mating engagement and sealing with the film.

Once the placement of the fitment channel and the fitment sealing member is completed, the film can be transmitted through the tube forming assembly. Generally, the film is formed over the outer surface 46 of the forming station, into at least a partially tubular configuration. The tubular configuration then extends along the vertical seal anvil. The outer edges of the film are configured to overlap each other. As the film proceeds along the vertical seal anvil 30, the overlapped edges pass the vertical seam sealer which seals the edges to each other (resulting in the formation of the tubular member). The particular amount of overlap of the edges is determined based upon a number of factors, and nothing herein limits the manner and type of seal that is effectuated about the side edges of the film.

Next, the film approaches a position wherein the fitment is applied to the film. In most instances, the fitment is sealed to the film through some type of sealing (RF welding, ultrasonic welding and/or heat sealing), but, it is contemplated that the fitment can be secured through a mechanical interface as well.

Due to the configuration of the fitment channel and the vertical seal anvil, the surface of the fitment that is to engage and to be coupled to the film is positioned in substantial abutment with the underlying film. When the film reaches the appropriate orientation, the fitment is positioned and the fitment sealing member 52 is activated to seal or otherwise couple the fitment to the film.

Once the fitment is secured, the film continues to the forming assembly, wherein the transverse seam sealer forms the transverse seams. Once a first transverse seam is formed, product is introduced into the partially formed bag. The product is distributed from the product supply source through the inner product supply tube and into the partially formed bag.

Next, the transverse seam sealer applies a second seal to the partially formed bag to complete the formation of the bag (and typically to form the first transverse seal of the immediately subsequent bag).

Figure 5:
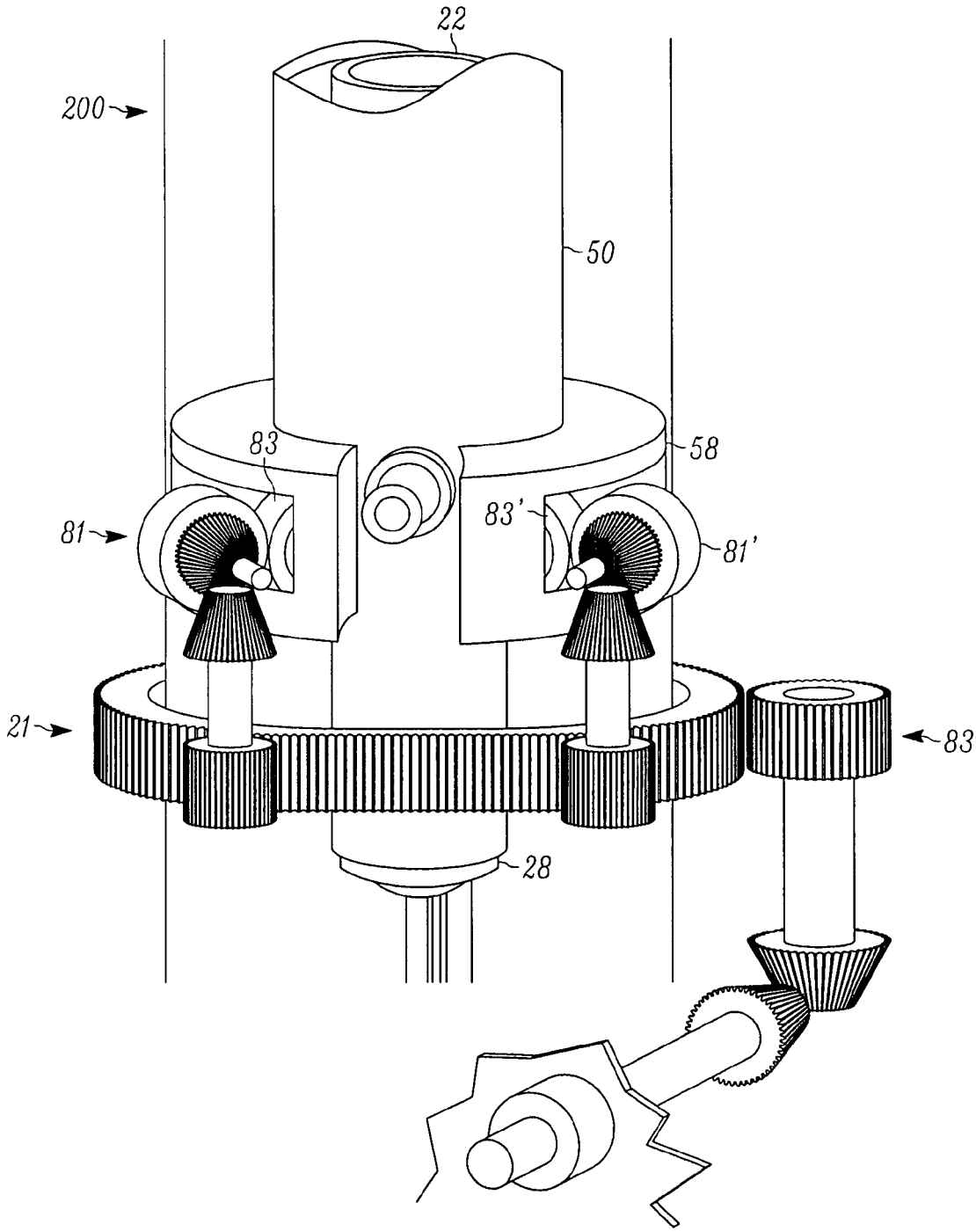
FIG. 5 of the drawings is a partial perspective view of an embodiment of the present system.
Figure 6A:
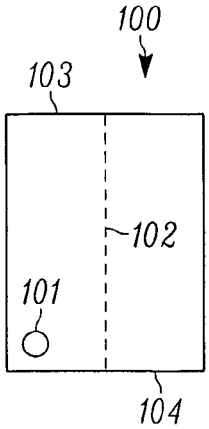
FIG. 6*a-g* of the drawings represent various bags with fitment placement at a number of different locations. It will be understood that the system allows for placement from the center to the edge from the top to the bottom. Thus, this allows for fitment placement in any direction (depending on which is the top and the bottom of the bag).
Figure 6B:
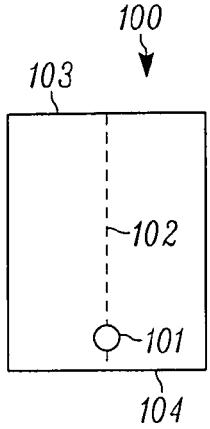
Figure 6C:
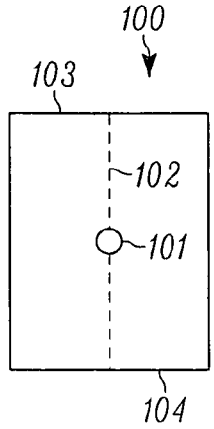
Figure 6D:
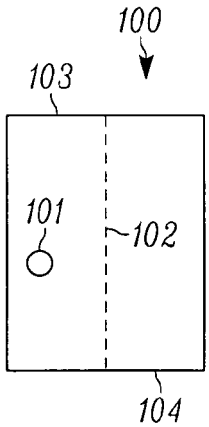
Figure 6E:
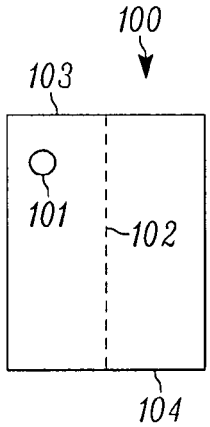
Figure 6F:
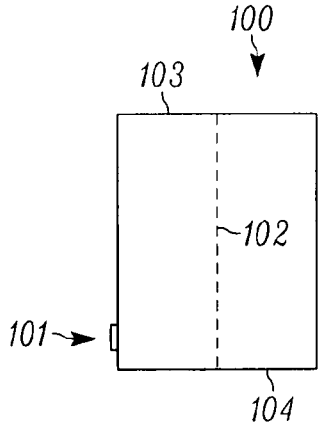
Figure 6G:
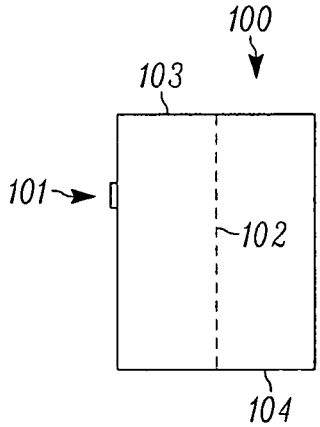

As for pulling the film through the system, and with reference to FIG. 5, a drive mechanism 21 can be positioned near the second end 58 of the fitment housing tube. A drive assembly, including outer drive wheels 81, 81' can be placed on the outside of film 200. The outer drive wheels are powered by a gear train 83 that couples to a power source (not shown). Additional idler wheels 85, 85'(same number as gear train) are positioned at or near the second end of the fitment housing tube 50. The film is positioned between the drive wheels and the idler wheels so that it is pinched therebetween. Subsequent rotation of the drive wheels pulls the film through the system. The idler wheels can rotate with the fitment housing tube (and a slot is provided which allows for the passage of the fitment therethrough). The outside drive system can be configured to rotate, or can include drive wheels which can be positioned to correspond to the idler wheels. Of course, a number of other systems are contemplated for use to pull the film through the system, and the system is not limited to the particular drive assembly shown.

It will be understood that modifications can be made to the system. Along with the fitment sealing member, an opening forming member can be provided that punches or otherwise forms an opening into the film corresponding to the fitment. In other embodiments, the fitment can be applied to the outside of the film. In such an embodiment, the fitment channel can be positioned along with the fitment sealing member on the rotating turret, and the fitment housing tube can be eliminated. In such an embodiment, the operation of coupling the fitment is completed on the outside of the system. In other embodiments, the fitment channel can be positioned on the rotating turret and the fitment sealing member can be positioned on the fitment housing tube. As such, the fitment is sealed from the inside but is coupled to the outside of the assembly.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A form fill seal system comprising:

a product fill assembly having an inner product supply tube with a proximal end and a distal end, the proximal end attachable to a product supply source;

a tube forming assembly having a vertical seal anvil having a first end and a second end, the vertical seal anvil extends about the product fill assembly, a vertical seam sealer is positioned along the vertical seam sealer between the first and second ends thereof;

a fitment securing assembly comprising a fitment housing tube positioned about the inner product supply tube and proximate the vertical seal anvil, the fitment housing tube having a fitment channel extending therealong having a fitment insertion end and a fitment coupling end, and, a fitment sealing member extending about the vertical seal anvil, and corresponding to the fitment coupling end of the fitment channel, wherein the fitment housing tube and the fitment sealing member, on the one hand, and the vertical seal anvil, on the other hand are rotatably positionable relative to each other, to, in turn, allow for the varying of the position of a fitment relative to the vertical seal anvil.

2. The system of claim 1 wherein the forming assembly further includes a forming station positioned proximate the first end of the vertical seal anvil.

3. The system of claim 1 wherein the inner product supply tube and the vertical seal anvil are substantially fixed in orientation relative to each other.

4. The system of claim 1 wherein the fitment channel can be rotated an arcuate width of at least 90°.

5. The system of claim 1 wherein the fitment sealing member is vertically adjustable relative, to in turn, allow for the placement of the fitment at various locations along a film placed within the system.

6. The system of claim 1 further including a drive system configured to pull film through the system, the drive system having a plurality of drive wheels rotatably positionable about a film positioned on the vertical seal anvil, and, a plurality of idler wheels positioned proximate a second end of the fitment housing tube, the plurality of drive wheels corresponding to the idler wheels, to, in turn, cooperate with each other to pinch and, in turn, linearly pull a film therebetween, upon rotation of the drive wheels.

7. A form fill seal system comprising:

a product fill assembly having an inner product supply tube with a proximal end and a distal end, the proximal end attachable to a product supply source;

a tube forming assembly having a vertical seal anvil having a first end and a second end, and, extending about the product fill assembly, a vertical seam sealer is positioned along the vertical seal anvil between the first and second ends thereof;

a fitment securing assembly comprising a fitment housing tube positioned about the inner product supply tube, and a turret extending about the product fill assembly, one of the fitment housing tube and the turret having a fitment channel extending therealong having a fitment insertion end and a fitment coupling end, the other of the fitment housing tube and the turret having a fitment sealing member substantially correspondingly positionable relative to the fitment coupling end of the fitment channel, wherein the fitment housing tube and the fitment sealing member, on the one hand, and the vertical seal anvil, on the other hand are rotatably positionable relative to each other, to, in turn, allow for the varying of the position of a fitment relative to the vertical seal anvil.

8. The system of claim 7 wherein the forming assembly further includes a forming station positioned proximate the first end of the vertical seal anvil.

9. The system of claim 7 wherein the inner product supply tube and the vertical seal anvil are substantially fixed in orientation relative to each other.

10. The system of claim 7 wherein the fitment channel can be rotated an arcuate width of at least 90°.

11. The system of claim 7 wherein the fitment sealing member is vertically adjustable, to in turn, allow for the placement of the fitment at various locations along a film placed within the system.

12. The system of claim 7 further including a drive system configured to pull film through the system, the drive system having a plurality of drive wheels rotatably positionable about a film, and, a plurality of idler wheels positioned proximate a second end of the fitment housing tube, the plurality of drive wheels corresponding to the idler wheels, to, in turn, cooperate with each other to pinch and, in turn, linearly pull a film therebetween, upon rotation of the drive wheels.

13. A method of applying a fitment to a film in a form fill seal system comprising the steps of:

providing a vertical seal anvil;

providing an inner supply tube inboard of the vertical seal anvil;

providing a fitment housing tube about the inner supply tube, the fitment housing tube having a fitment channel which is rotatably positionable;

providing a fitment sealing member positionable to be substantially correspondable with the fitment channel;

at least one of rotatably adjusting the position of the fitment channel, and rotatably adjusting the fitment sealing member to correspond to the fitment channel;

providing at least one fitment into the fitment channel;

placing the fitment into substantial abutment with a film placed about the vertical seal anvil; and sealing the fitment to the film with the fitment sealing member.

14. The method of claim 13 further comprising the step of vertically adjusting the position of the fitment sealing member.

* * * * *